United States Patent [19]

Fleissner

[11] Patent Number: 4,548,106

[45] Date of Patent: Oct. 22, 1985

[54] PROCESS AND APPARATUS FOR CONTINUOUS CUTTING OF STRIP- OR ROPE-LIKE MATERIAL

[75] Inventor: Heinz Fleissner, Riehen, Switzerland

[73] Assignee: Fleissner GmbH & Co., Engelsbach, Switzerland

[21] Appl. No.: 593,263

[22] Filed: Mar. 26, 1984

[30] Foreign Application Priority Data

Mar. 26, 1983 [DE] Fed. Rep. of Germany ..... 3311190

[51] Int. Cl.[4] ..... D01G 1/04

[52] U.S. Cl. ..... 83/18; 83/20; 83/37; 83/346; 83/431; 83/439; 83/566; 83/913; 83/403

[58] Field of Search ..... 83/913, 18, 566, 431, 83/20, 37, 346, 439, 403

[56] References Cited

U.S. PATENT DOCUMENTS 3,744,361 7/1973 Van Doorn et al. ..... 83/913 X
4,141,115 2/1979 Fourne et al. ..... 83/913 X
4,237,758 12/1980 Lindner et al. ..... 83/913 X
4,391,169 7/1983 Laird et al. ..... 83/913 X

*Primary Examiner*—Donald R. Schran
*Attorney, Agent, or Firm*—Antonelli, Terry & Wands

[57] ABSTRACT

According to the disclosed process, an endless fibrous material to be cut is wound in spiral form onto a rotatable cutter roll having radially outwardly oriented knives. A cutting force acts from the outside of the cutter roll radially inwardly, by way of a pressure roller contacting the wound material, for cutting, for example, synthetic fibers. In the process, at least two cutting forces are effective against the axis of the cutter roll, these forces being directed against each other. In the apparatus for conducting the process, two pressure rollers are articulated to each other by way of a double rocket arm. Consequently, the optimum cutting level, which will be different in individual cases, is automatically set. The effective cutting force for each roller is of equal strength.

15 Claims, 3 Drawing Figures

PROCESS AND APPARATUS FOR CONTINUOUS CUTTING OF STRIP- OR ROPE-LIKE MATERIAL

This invention relates, first of all, to a process for cutting strips, cables, tows, yarns, ribbons and the like textile material, especially for the production of staple fibers of synthetic fiber tows, wherein a continuous filamentary material to be cut is fed to a cutter roll having a plurality of radially oriented cutting knives and is cut by a force acting in the radial direction between the material and the cutter roll. For this purpose, a wound package having radially superimposed winding layers is formed continuously from the material to be cut in such a way that the material, respectively, newly fed to the cutter roll forms a lap of the wound package that is radially farthest away from the knife blades, and that continuously the winding layer that is radially intermost; i.e., farthest on the inside, is cut through by the knife blades of the cutters.

One process of this type is carried out in connection with the staple fiber cutting machine according to DOS No. 1,660,286. In this process, a tow is wound in spiral form onto a cutter cage and cut by means of an externally effective pressure at a distance corresponding to the knives. The device operates with a long operating lifetime since the knives are exposed to only low wear and tear. The staple fibers urged into the interior of the cutter cage fall due to gravity out of the horizontally aligned cutter cage or drop downwardly with the aid of a suction draft so that room is made in the interior of the cutter cage for the subsequently following staple fibers.

In practice, there is the constant need for building a conventional apparatus more efficiently. This increase in efficiency resides in a higher output of products per unit time and, in this connection, also with respect to staple fibers of any desired length. It is especially difficult to cut short staple fibers with the aid of this known process since, on the one hand, very great cutting forces, which also stress the bearing of the cutting disk, are required for this purpose, while, on the other hand, the transporting of the cut staple fibers out of the space between the cutters becomes increasingly difficult with reduced staple fiber lengths. Although such transportation is possible by increasing the force acting from the outside on the material to be cut, there are limits from a mechanical viewpoint. Besides, forces which are not only greater and act in the radial direction, but also relatively great forces which subject the knives to bending stresses are exerted on the cutting knives when increasing the cutting force acting from the direction of the pressure rolls; these forces destroy the knives more rapidly.

Starting with the process of the type discussed above, the invention is based on the object of further developing the process in such a way that, in spite of the recited difficulties, a higher output is made possible thereby, especially of any desired staple fiber length, without incurring a higher bending stress on the cutting knives.

In order to attain this object, the invention provides that the force generating a cutting pressure at only one angle acts against the wound material from the outside more than just once. By making such cutting forces advantageously effective so that the forces are oriented against each other, and preferably have the same arithmetic sign, then, with an increase in the force necessary for cutting, the resulting pressure exerted on the bearing of the cutter wheel is smaller, in some cases even zero; consequently, with the aid of this process, minimum staple fiber lengths can be produced preferably, and this is accomplished with a large output of production.

The apparatus for effecting this process consists, first of all, of a cutter cage carrying several layers of wound tow with two knife-supporting disks arranged axially in superposition and at approximately knife-length spacing; between these knife-supporting disks, at a distance corresponding to the desired staple, a plurality of radially outwardly oriented knives is held in place; on the outside, at a spacing, a pressure roll is associated with the cutter cage to obtain the radially inwardly acting cutting pressure on the wound-up tow. An apparatus of this type has been known from the aforementioned DOS No. 1,660,286, or from the German Utility Model No. 66 05 801. In a simple way, this construction is now supplemented by at least one additional pressure roller, so that the pressure roller associated with the cutter cage are, preferably, arranged approximately in mutual opposition and directed toward each other with respect to their pressure action. The two pressure rollers can be arranged in exact diametrical opposition. However, for special reasons, it is more advantageous to arrange them mutually offset diametrically toward each other with a relatively small angle. In this instance, the bearing pressure on the cutter cage is not equal to zero, but of such a minimum size that even with an increase in contact pressure the bearing pressure is negligibly small.

Thus, with respect to the resultant bearing pressure at the cutter cage, the contact pressure exerted by the pressure rollers could even become infinitely high. However, with this construction, there is the advantageous premise for the operating life of the knives that, even though the sum total of the cutting forces is higher, the individually effective cutting forces are halved. This is due to the fact that the second pressure roller, as seen in the direction of revolution of the cutter cage, needs merely to supplement the cutting work performed by the first pressure roller and, furthermore, the second pressure roller is effective at a lower cutting level. This is so because, due to the contact pressure at the first pressure roller, the tow is already reduced in its wound-up thickness, and staples are cut, at least partially, so that at the second pressure roller, the spacing between the periphery of the pressure roller and the blades of the knives is reduced as contrasted to the initial spacing between the first pressure roller and the blades. However, the magnitude of the cutting pressure should be the same.

As is conventional, the pressure roller is mounted to the housing of the apparatus on an articulated lever arm. A pressure piston-cylinder unit for the generation of a constant cutting pressure acts on the ends of the lever arm arranged in opposition to the pressure roller. According to the invention, the lever arms of the two pressure rollers are connected with each other. Thereby, a trapezoidal-like double rocker arm is produced, the pressure rollers being rotatably supported at the free ends thereof. The length of the transverse connection between the lever arms determines the mutual distance of the pressure rollers and, thus, the height of the respective cutting level with respect to the tow windings. The transverse connection is established, according to the invention, by a pressure piston-cylinder unit; for this purpose, one lever arm, for example, engages the housing of this unit and the other arm the piston in an articulated fashion. On the basis of this construction, the optimum cutting level is advantageously adjusted automatically at the respective pressure roller; namely, with respectively identical cutting force. Thus, the sum total of the cutting levels is adjusted beforehand at the piston-cylinder unit, the cutting force resulting therefrom in dependence on the quality of the cutting knives, the mutual spacing of the knives, and the properties of the wound material.

The invention is hereinafter described with reference to an apparatus having only one cutter cage. It is, of course, likewise possible to arrange two cutter cages in immediate superposition, and to associate two pressure rollers with each of these cutter cages. The two cutter cages can, of course, be provided with four knive-supporting disks, but can also be constructed with only three disks and can be equipped with continuous blades.

One embodiment of the apparatus of this invention is illustrated in the drawings wherein.

Figure 1:
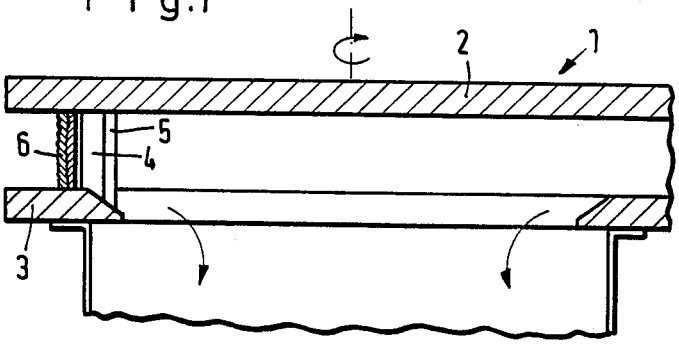
FIG. 1 shows a sectional view of a cutting wheel or cutter roll with a cutter cage.
Figure 2:
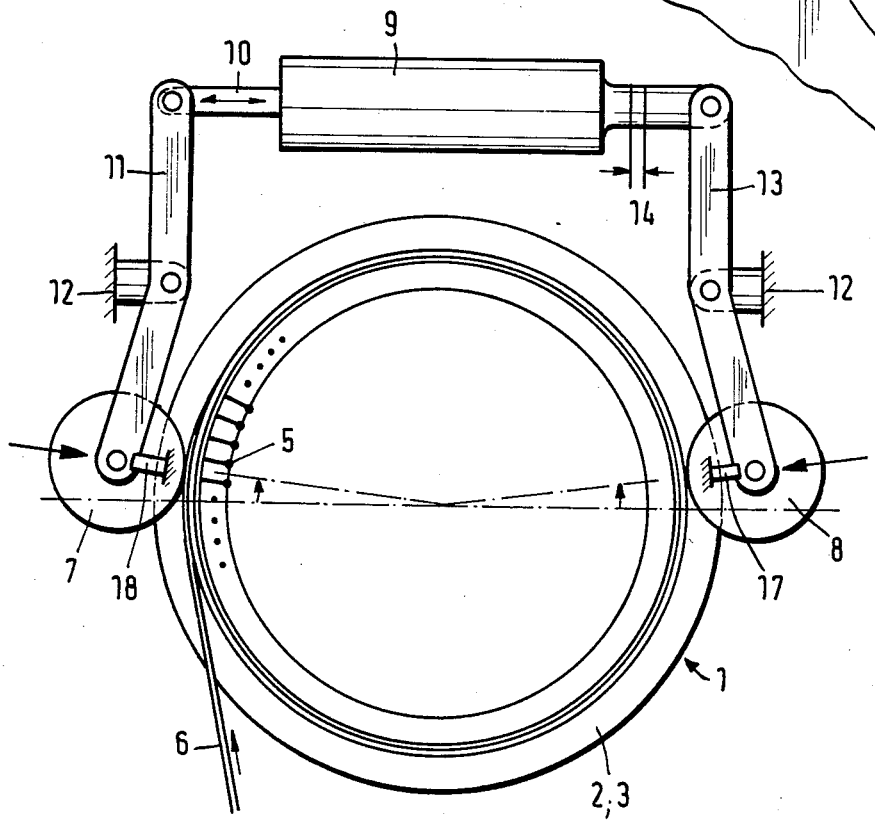
FIG. 2 is a section through the cutting wheel of FIG. 1 at the level of the knife crown with two pressure rollers oriented against this crown.

The staple fiber cutting machine shown in a schematic view includes a horizontally arranged cutting wheel, denoted by reference numeral 1 in its entirely, which comprises an upper knife-supporting disk 2 and a knife-supporting disk 3 arranged therebelow. The radially oriented knives 4, which can also be seen in FIG. 2, are arranged between the knife-supporting disks 2, 3 located at a mutual spacing; the knives are held in the knife-supporting disks 2, 3 by means of rearwardly positioned knife holders 5. The knife holders 5 can also be omitted under certain conditions. The fiber tow 6 to be cut is spirally wound onto the knife crown of the cutting wheel 1. While the innermost lap rests directly on the blades of knives 4, the outermost lap is exposed initially to the pressure roller 7 and, subsequently thereto, after an angle of rotation of less than 180°, to the pressure roller 8. The pressure rollers 7, 8 are arranged fixedly in opposition to the rotating cutting wheel 1 with an essentially constant spacing from the axis of the cutting wheel. On account of the tow, wound under tension onto the cutting wheel, a radially inwardly oriented cutting pressure acts in the zone of the pressure rollers 7, 8 on each of the individual knives located therebelow; this cutting pressure divides the fibers of the innermost lap on the blades of the knives. The thus-produced staples are then urged further radially inwardly into the cutting wheel 1 by the subsequently wound fibers and, thereafter, carried away vertically downwardly; e.g., by gravity and/or a suction draft, in correspondence with the arrows in FIG. 1. The cutting wheel is rotated by a motor (not shown).

It is referable if the two pressure rollers 7 and 8 are arranged exactly opposite one another. Reasons of construction result in the reduction of the angle of rotation; i.e., less than 180° as shown in FIG. 2. The production of the angle amounts to about 5° to 8° on both sides.

A force effective from the outside against the wound package is required for cutting the fibers 6, this force acting essentially exactly in the direction of the axis of rotation of the cutting wheel 1. On account of this force, a resultant force of the same size is obtained in the bearing of the cutting wheel (not shown). The cutting pressure at the pressure roller 7 is generated by way of a pressure piston-cylinder unit 9 arranged in the same plane as the cutting wheel outside of the housing 12 embodying the bearing. That is, the unit 9 is positioned directly behind the cutting wheel as shown in FIG. 1. The piston 10 of the unit engages in an articulated fashion one end of a double arm 11 pivotably mounted to the housing 12 and carrying at the other end the pressure roller 7. It is possible to arrange, in contrast to the arrangement of the piston-cylinder unit shown in FIG. 1, the piston 9, likewise, at the housing of the apparatus.

According to this invention, another pressure roller 8 acts in opposition to the pressure roller 7 against the wound-up textile material 6, for which purpose a further double frame 13 is pivotably mounted to the housing 12 and carries, at one end, the pressure roller 8 and at the other end is in articulated engagement with the cyliner of unit 9. On account of this construction, a trapezoidal double rocker arm has been created which can freely swing to and fro in dependence on the forces acting thereon. For production of the required cutting pressure, it is merely necessary to set the clearance between the pressure rollers 7 and 8 at the pressure piston-cylinder unit 9. For this purpose, a coupling 14 is arranged at the cyliner of unit 9 for effecting the adjustment of unit 9 along the lines of lengthening or shortening of the unit. Unit 9 is freely suspended so that the position of the unit adjusts itself in such a way that the pressure forces of the pressure rollers against the cutting wheel are the same.

If, now, the initially empty cutting wheel 1 is looped around by a tow 6 to be cut, a cutting pressure is gradually built up at the pressure rollers 7 and 8 on account of the increasing thickness of the wound spirals of textile material. In this arrangement, the cutting level between the cutting edges of the knives 5 and the periphery of the pressure roller 7 will adjust itself to be higher at the pressure roller 7 than with the pressure roller 8 inasmuch as the thickness of the wound tow is reduced by the pressure at the pressure roller 7 and simultaneously several fibers are being cut, so that only a lesser cutting level is required for obtaining a cutting pressure of equal magnitude at the pressure roller 8. The respective cutting level at the pressure rollers 7 and 8 is set automatically on the basis of the rocker-arm construction of the double arms 11, 13 together with the pressure piston-cycliner unit 9; namely, due to the fact that the cutting force must, in each case, be of equal size; whereas the cutting level will vary with pressure rollers 7 and 8.

Figure 3:
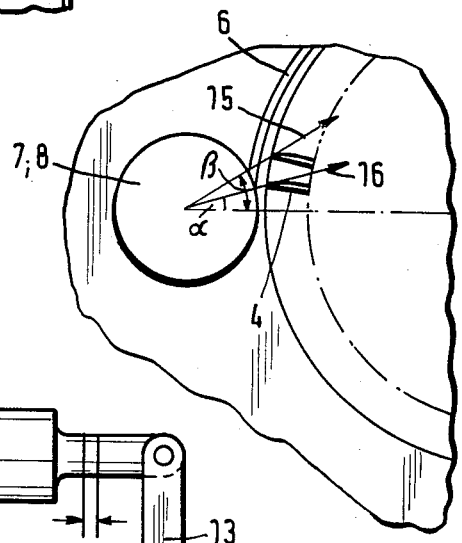
FIG. 3 shows a fragmentary view from the zone of pressure roller/knife crown, illustrating the ensuing bending forces at varying cutting levels.

The advantage of this construction resides not only in that the pressure on the bearing of the cutting wheel 1 is negligibly small as compared to the conventional construction, but also in that the cutting force at each of the pressure rollers, required to produce the staple fibers, is halved with the use of two pressure rollers 7, 8. This feature not only entails advantages with respect to the operating life of the knives 5 on account of the lower radially acting cutting pressure, but also on account of the lower bending pressure initially acting obliquely on each knife, as illustrated in FIG. 3. When the rotating cutting wheel, with the built-up wound package of tow 6, moves toward the pressure roller, a bending force 15, 16 increases with the approaching of the respective knife toward the pressure roller 7, 8, respectively. With larger cutting forces, this bending force is correspondingly stronger, resulting in a loss of operating lifetime of the knives.

However, by the arrangement of this invention of producing more than one cutting force, this cutting force is not only reduced in size, but also the effective cutting level is cut in half. In the conventional construction, with a higher cutting level in correspondence with a larger wound package of tow, the angle would prevail in the approach of each knife at the instant of first cutting. Here, the bending force acting on the knife in the direction of ray 15 is greater than the halved cutting level where the angle will result with the cutting knife, and, accordingly, the bending force will be correspondingly reduced.

Since, in the process of this invention, a halved cutting level is utilized, care must be taken that the pressure rollers do not move below a minimum distance to the cutting blades of the knives. For this purpose, a stop 17, 18 is provided on which rests the axle of the pressure roller 8 or 7 when the cutting wheel is empty. Correspondingly, the pressure roller 7 is swiveled out to half the cutting level during startup of the cutting device, and the pressure roller 8 is pivoted to the minimum cutting gap in accordance with stop 17. Once the tow is seized by the second pressure roller 8, both pressure rollers 7, 8 will oscillatingly adjust to a spacing from the cutting wheel at which equally high cutting forces are effective.

What is claimed is:

1. A process for cutting strip- or rope-like textile material, especially for the production of staple fibers from synthetic fiber tows, which comprises feeding the textile material to be cut to a rotating cutting wheel to form a wound package thereon, said cutting wheel having a plurality of cutting knives pointing in the radial direction, cutting the textile material by at least two forces acting in the radial direction between the textile material and the cutting wheel, the wound package with radially superimposed winding laps being continuously formed from the textile material in such a way that the textile material, respectively, newly fed to the cutting wheel forms a winding layer of the wound package lying radially farthest away from the cutting blades, and that continuously the winding layer laying radially intermost on the inside is cut through by the cutting blades of the cutting knives, said at least two forces producing cutting pressure on the wound package from the outside of the cutting wheel against the wound material and including two forces that are, respectively, acting in a direction in opposition to each other.

2. A process according to claim 1, wherein only two cutting forces are applied to said wound package and, respectively, are acting in a direction in opposition to each other.

3. A process according to claim 2, wherein the cutting forces acting on the wound package have, respectively, identical magnitude.

4. A process according to claim 2, wherein two equal cutting forces are applied simultaneously against said wound material.

5. An apparatus for cutting continuous strips, ropes, tows or the like continuous textile material which comprises a rotatable cutting wheel adapted to be wrapped around several times by a tow to be cut, said wheel having two knife-supporting disks arranged axially one above the other and at a mutual spacing, a plurality of radially outward oriented knives held, at a spacing corresponding to a desired staple length, between said supporting disks, and at least two pressure rollers arranged on the outside of the cutting wheel at a spacing therefrom for providing a radially inwardly oriented cutting pressure on the wound-up tow whereby the tow is cut into staple fibers of the desired staple length; said at least two pressure rollers including two pressure rollers arranged in approximate opposition and directed towards each other with respect to the pressure forces applied to the tow.

6. An apparatus according to claim 5, wherein only two pressure rollers are associated with the cutting wheel, said rollers being arranged in approximate opposition and directed toward each other with respect to the pressure forces applied to said tow.

7. An apparatus according to claim 6, further comprising a lever arm for each pressure roller that is articulated to a housing in which the cutting wheel is located, the lever arms of the pressure rollers by way of which a pressure force is applied to the wound material being connected with each other via a connecting means.

8. An apparatus according to claim 7, wherein the ends of the lever arms arranged in opposition to the pressure rollers are extended past the housing carrying the cutting wheel and are articulated together to form a double rocker arm.

9. An apparatus according to claim 8, wherein the ends of the lever arms are joined together by the connecting means which comprises a pressure piston-cylinder unit; one lever arm being articulated to the housing of the unit and the other lever arm being articulated to the piston of the unit.

10. An apparatus according to claim 8, wherein the cutting level, provided by the spacing of the pressure rollers to the cutting blade of the knives, is adjustable at the unit by means for varying the free swivel angle of the double rocker arm.

11. An apparatus according to claim 10, wherein the cutting level at the two pressure rollers is different, but the respective cutting force of each roller is equal.

12. An apparatus according to claim 5, wherein the minimum distance between each of the pressure rollers and the cutting blades of the associated knives is adjustable by a stop member.

13. An apparatus according to claim 5, wherein two or more cutting wheels are arranged directly in superposition and are provided with knives extending all the way through from one wheel to the other.

14. An apparatus according to claim 5, wherein only two pressure rollers are associated with the cutting wheel, further comprising means for causing said two pressure rollers arranged in approximate opposition to to each other to apply two equal forces simultaneously to said wound package.

15. An apparatus according to claim 5, further comprising a lever arm for each pressure roller that is articulated to a housing in which the cutting wheel is located, the lever arms of the pressure rollers by way of which a pressure force is applied to wound material being connected to each other via a connecting means.

* * * * *